US011688551B2

(12) United States Patent
Yamashita

(10) Patent No.: US 11,688,551 B2
(45) Date of Patent: Jun. 27, 2023

(54) METHOD FOR PRODUCING METAL FOILS

(71) Applicant: TOYOTA JIDOSHA KABUSHIKI KAISHA, Toyota (JP)

(72) Inventor: Osamu Yamashita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/152,153

(22) Filed: Jan. 19, 2021

(65) Prior Publication Data

US 2021/0233705 A1 Jul. 29, 2021

(30) Foreign Application Priority Data

Jan. 24, 2020 (JP) ..... 2020-010086
Aug. 25, 2020 (JP) ..... 2020-142063

(51) Int. Cl.
*H01F 41/02* (2006.01)
*C21D 1/34* (2006.01)
*H01F 1/153* (2006.01)

(52) U.S. Cl.
CPC ..... *H01F 41/02* (2013.01); *C21D 1/34* (2013.01); *H01F 1/153* (2013.01)

(58) Field of Classification Search
None
See application file for complete search history.

(56) References Cited

U.S. PATENT DOCUMENTS 4,437,912 A * 3/1984 Sakakima ..... H01F 1/153 148/304
6,004,661 A * 12/1999 Sakai ..... H01F 1/15308 428/812

(Continued)

FOREIGN PATENT DOCUMENTS

CN 1303108 A 7/2001
CN 104139996 A * 11/2014

(Continued)

OTHER PUBLICATIONS

Machine Translation of CN-104139996-A (Year: 2014).*
Machine Translation of WO-9619814-A1 (Year: 1996).*

*Primary Examiner* — Kevin E Yoon
*Assistant Examiner* — Ryan L Heckman
(74) *Attorney, Agent, or Firm* — Sughrue Mion, PLLC

(57) ABSTRACT

The method heats the metal foil made of amorphous soft magnetic material while bringing the metal foil into close contact with a placement surface of a metal base such that the metal foil conforms to the placement surface, to crystallize the amorphous soft magnetic material of the metal foil into nano-crystal soft magnetic material. In the crystallization, the metal foil is heated at a heating temperature to crystallize the amorphous soft magnetic material, the heating temperature being higher than or equal to a crystallization starting temperature at which the amorphous soft magnetic material crystallizes into nano-crystal soft magnetic material and allowing a temperature of the placement surface to be lower than a temperature of the metal foil having temperature rise due to heat generated by self-heating during crystallization, and the heat generated by self-heating of the metal foil during crystallization is absorbed by the base.

4 Claims, 6 Drawing Sheets

(56) References Cited

U.S. PATENT DOCUMENTS

| | | | | |
|---|---|---|---|---|
| 2001/0011948 | A1* | 8/2001 | Rasband | H01F 41/043 340/572.5 |
| 2001/0015239 | A1 | 8/2001 | Kanekiyo | |
| 2004/0112468 | A1* | 6/2004 | Petzold | H01F 41/0226 148/121 |
| 2008/0196795 | A1* | 8/2008 | Waeckerle | H01F 41/0226 148/540 |
| 2015/0162118 | A1* | 6/2015 | Kato | H01F 1/28 336/221 |
| 2017/0011829 | A1* | 1/2017 | Moritsugu | H01F 41/0226 |
| 2017/0229237 | A1* | 8/2017 | Makino | C22C 45/02 |
| 2017/0271063 | A1* | 9/2017 | Kato | C22C 33/02 |
| 2018/0127851 | A1 | 5/2018 | Reed, Jr. et al. | |
| 2019/0077622 | A1* | 3/2019 | Ando | B65H 3/60 |
| 2019/0123376 | A1* | 4/2019 | Ando | B32B 37/18 |
| 2020/0216926 | A1* | 7/2020 | Ito | C22C 38/00 |
| 2020/0373084 | A1 | 11/2020 | Yamashita | |
| 2020/0385832 | A1 | 12/2020 | Yamashita et al. | |
| 2021/0310097 | A1* | 10/2021 | Azuma | B22D 11/00 |

FOREIGN PATENT DOCUMENTS

| | | | | |
|---|---|---|---|---|
| CN | 106030732 | A | 10/2016 | |
| CN | 107043847 | A | 8/2017 | |
| JP | 61-125104 | A | 6/1986 | |
| JP | 2017-141508 | A | 8/2017 | |
| JP | 2019534942 | A | 12/2019 | |
| JP | 2020-189774 | A | 11/2020 | |
| JP | 2020-202204 | A | 12/2020 | |
| WO | WO-9619814 | A1 * | 6/1996 | H01F 17/02 |
| WO | 2019/009309 | A1 | 1/2019 | |

* cited by examiner

METHOD FOR PRODUCING METAL FOILS

CROSS REFERENCE TO RELATED APPLICATIONS

The present application claims priority from Japanese patent application JP 2020-10086 filed on Jan. 24, 2020 and Japanese patent application JP 2020-142063 filed on Aug. 25, 2020, the entire content of which is hereby incorporated by reference into this application.

BACKGROUND

Technical Field

The present disclosure relates to a method for producing metal foils made of nano-crystal soft magnetic material.

Background Art

Conventional motors, transformers, and the like use a laminate obtained by laminating metal foils as a core. For example, JP 2017-141508 A suggests a method for producing metal foils, including heating metal foils made of amorphous soft magnetic material in a laminated state to crystallize the amorphous soft magnetic material of the metal foils into nano-crystal soft magnetic material.

SUMMARY

It is commonly known that when amorphous soft magnetic material is crystallized into nano-crystal soft magnetic material, the material generates heat by itself, and it is known that the self-heating temperature when the material generates heat by itself is higher than a temperature at which crystallization of the material begins. Therefore, as described in JP 2017-141508 A, for example, heating metal foils in a laminated state may cause the metal foils to be excessively heated due to the accumulation of heat generated by self-heating of the material between the metal foils. Furthermore, among the laminated metal foils, variation in heating temperature occurs between the metal foils located inside and the metal foils located outside. Consequently, variation in size of the crystals of the metal foils may occur.

In view of the foregoing, metal foils may be heated one by one on a heated base, without being laminated on each other. However, when the metal foils are warped, for example, a larger proportion of the metal foils may not be in contact with the base, and this may result in variation in temperature of the metal foils during crystallization. In particular, heat tends to be accumulated in a gap between the metal foils not in contact with the base and the base, and the accumulation of heat may cause excessive temperature rise of the metal foils not in contact with the base, resulting in generation of coarse crystals. Consequently, variation in size of the crystals of the metal foils may occur, and the magnetic properties of the metal foils may decrease.

The present disclosure has been made in view of the foregoing, and provides a method for producing metal foils, capable of crystalizing amorphous soft magnetic material of the metal foils into nano-crystal soft magnetic material having uniformly-sized crystals by uniformly heating the metal foils.

The method for producing metal foils according to the present disclosure is a method for producing metal foils made of nano-crystal soft magnetic material, the method including preparing a metal foil made of amorphous soft magnetic material; and heating the prepared metal foil while bringing the metal foil into close contact with a base made of metal such that the metal foil conforms to a placement surface of the base, to crystallize the amorphous soft magnetic material of the metal foil into the nano-crystal soft magnetic material. In the crystallization, the metal foil is heated at a heating temperature to crystallize the amorphous soft magnetic material, the heating temperature being higher than or equal to a crystallization starting temperature at which the amorphous soft magnetic material crystallizes into the nano-crystal soft magnetic material and allowing a temperature of the placement surface to be lower than a temperature of the metal foil having temperature rise due to heat generated by self-heating during crystallization, and the heat generated by self-heating during crystallization is absorbed by the base.

In the present disclosure, firstly a metal foil made of amorphous soft magnetic material is prepared. Next, while bringing the metal foil into close contact with the base made of metal such that the metal foil conforms to the placement surface of the base, the metal foil in a state of being in close contact with the base is heated to crystallize the amorphous soft magnetic material of the metal foil into nano-crystal soft magnetic material. At this time, the metal foil is heated at a heating temperature that is higher than or equal to a crystallization starting temperature at which the amorphous soft magnetic material crystallizes into nano-crystal soft magnetic material and that allows the temperature of the placement surface to be lower than the temperature of the metal foil having temperature rise due to heat generated by self-heating during crystallization. This allows the amorphous soft magnetic material of the metal foil to crystallize and also allows the base to absorb via the placement surface thereof the heat generated by self-heating of the metal foil because the temperature of the placement surface of the base is lower than the temperature of the self-heated metal foil. Herein, since the metal foil is in close contact with the base, the heat of the metal foil is uniformly absorbed by the base, and the metal foil has a uniform temperature during crystallization. Thus, the crystals of the metal foil can be crystallized into uniformly-sized crystals. Consequently, it is possible to suppress decrease in the magnetic properties of the metal foil due to variation in size of the crystals (specifically, generation of coarse crystals).

In the crystallization, when heating the metal foil, the metal foil may be sandwiched and heated with the heat of the heater or the heat of hot air from a position facing the base, for example. In some embodiments, however, the metal foil is heated by the heater embedded in the base in the crystallization.

Such an embodiment can uniformly heat the placement surface of the base with the heater embedded in the base and uniformly heat the metal foil with the heat generated by the heating. In addition, the temperature of the placement surface is lower than the temperature of the self-heated metal foil during crystallization and the placement surface has a uniform temperature, and thus the heat of the metal foil generated by itself can be uniformly absorbed by the base via the placement surface.

It should be noted that as long as the metal foil can be brought into close contact with the base without warping, a magnet or an electromagnet, for example, may be provided in the base, and the metal foil may be brought into close contact with the base with a magnetic force. In some embodiments, however, in the crystallization, when the metal foil is brought into close contact with the base, the metal foil is brought into close contact with the base by suction from a suction port formed in the base.

Such an embodiment can correct warping of the metal foil and bring the metal foil into close contact with the surface of the base without a gap by sucking the metal foil from the suction port formed in the base. In addition, even if the surface of the base has, for example, foreign matter or the like thereon, the foreign matter may be sucked from the suction port. This can prevent the foreign matter from entering the space between the metal foil and the base.

In some embodiments, in the preparing the metal foil, a molten metal obtained by melting material of the metal foil is blown onto a rotating roll, and the molten metal is cooled and solidified on the roll to produce the metal foil made of the amorphous soft magnetic material, and when the metal foil is brought into close contact with the base, one of surfaces of the metal foil is brought into close contact with the placement surface, the one of surfaces having been in contact with the roll.

Such an embodiment produces the metal foil made of amorphous soft magnetic material by using a method including blowing a molten metal obtained by melting material of the metal foil onto a rotating roll and cooling and solidifying the molten metal on the roll, that is, a so-called single-roll method. Since one of the surfaces of the thus-obtained metal foil having been in contact with the roll has less unevenness as compared to the other surface, the embodiment can bring the surface of the metal foil into close contact with the placement surface of the base more uniformly and can uniformly heat the metal foil in a state where it is uniformly in close contact with the placement surface of the base. This facilitates the uniform crystallization of the metal foil, prevents non-uniform plastic deformation of the metal foil along with the contraction during crystallization, and thus can laminate the crystallized metal foils more precisely.

Furthermore, in some embodiments, in the preparing the metal foil, a metal foil made of iron-based amorphous soft magnetic material is prepared as the metal foil, and in the crystallization, the metal foil is disposed on a support member, the metal foil is sandwiched between the base and the support member by moving at least one of the base or the support member in a direction to bring the base and the support member close to each other to bring the metal foil into close contact with the base, and the metal foil is heated by a heater embedded in the base. In the crystallization, either the following condition (i) or condition (ii) is satisfied: (i) material of the support member has a thermal conductivity of 0.2 W/mK or lower; and (ii) the support member has a temperature of 300° C. or higher and lower than the crystallization starting temperature.

Such an embodiment can relatively bring the support member, on which the metal foil is disposed, close to the base, and thus can sandwich the metal foil between the base and the support member to bring the metal foil into close contact with the base more uniformly.

At this time, the metal foil is heated by the heater embedded in the base to crystallize, and when the condition (i) material of the support member has a thermal conductivity of 0.2 W/mK or lower, is satisfied, heat is less likely to be absorbed by the support member. Specifically, even if deviation for example occurs in temperature distribution of the placement surface of the base upon close contact with the metal foil, due to the shape of the metal foil such as distortion or warping, the heat of the metal foil is less likely to be absorbed by the support member, and the temperature distribution of the metal foil tends to become uniform. This can prevent the temperature of the placement surface of the base from locally decreasing in a state where the metal foil is in close contact with the base. Consequently, this facilitates the uniform crystallization of the metal foil, prevents non-uniform plastic deformation of the metal foil along with the contraction during crystallization, and thus can laminate the crystallized metal foils more precisely.

Herein, when the material of the support member has a thermal conductivity higher than 0.2 W/mK, the heat of the placement surface of the base tends to escape to the support member via the metal foil. Thus, even if deviation for example occurs in temperature distribution of the placement surface of the base when the metal foil comes into close contact with the base, the deviated temperature distribution is less likely to become uniform and since the crystallization of the metal foil begins from a high-temperature portion thereof ahead of the other portions, the metal foil 10 contracts along with crystallization at different timings depending on the portions. As a result, the metal foil may have non-uniform plastic deformation, and the crystallized metal foils may not be laminated precisely.

Meanwhile, when the metal foil is heated by the heater embedded in the base to crystallize, even if the condition (ii) the support member has a temperature of 300° C. or higher and lower than the crystallization starting temperature of the metal foil, is satisfied, the heat of the base is less likely to be absorbed by the support member because the base and the support member has a small temperature difference therebetween. Specifically, even if deviation for example occurs in temperature distribution of the placement surface of the base when the metal foil comes into close contact with the base, due to the shape of the metal foil such as warping, the heat of the metal foil is less likely to be absorbed by the support member and the temperature distribution of the metal foil tends to become uniform. This can prevent the temperature of the placement surface of the base from locally decreasing in a state where the metal foil is in close contact with the base. Consequently, this facilitates the uniform crystallization of the metal foil, prevents non-uniform plastic deformation of the metal foil along with the contraction during crystallization, and thus can laminate the crystallized metal foils more precisely.

Herein, when the support member has a temperature lower than 300° C., the heat of the placement surface of the base tends to escape to the support member via the metal foil. Thus, if variation occurs in temperature of the placement surface, the level of crystallization of the metal foil varies depending on the portions according to such temperature variation, and this causes the metal foil 10 to contract along with crystallization at different timings depending on the portions. As a result, the metal foil may have non-uniform plastic deformation, and the crystallized metal foils may not be laminated precisely. Meanwhile, when the support member has a temperature higher than or equal to the crystallization starting temperature of the metal foil, crystallization may occur in the metal foil when the metal foil is disposed on the support member (that is, before the metal foil is sandwiched between the base and the support member), and the effect of crystallization of the metal foil by the heat of the base may not be produced.

According to the method for producing metal foils of the present disclosure, metal foils made of amorphous soft magnetic material are uniformly heated without the excessive temperature rise of the metal foils so that the amorphous soft magnetic material can be crystallized into nano-crystal soft magnetic material having uniformly-sized crystals.

DETAILED DESCRIPTION

Figure 1:
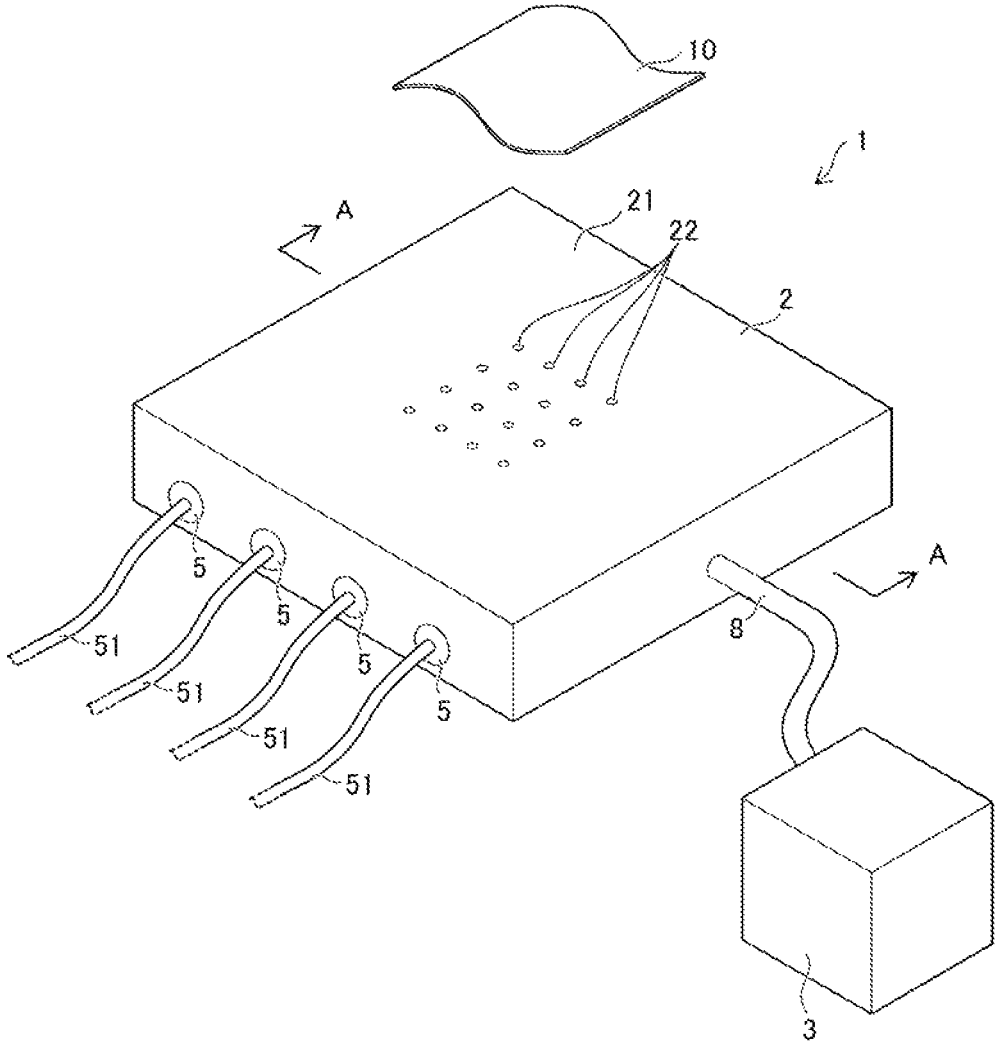
FIG. 1 is a schematic perspective view of a heating device that is used to perform a method for producing metal foils according to an embodiment of the present disclosure.

Hereinafter, a method for producing metal foils according to the present disclosure will be described with reference to the drawings. With reference to FIG. 1 to FIG. 4, a metal foil to be used will be described first, and then a production method therefor according to each embodiment will be described.

1. Metal Foil 10

A metal foil produced in the present embodiment is a metal foil made of nano-crystal soft magnetic material. The production method described below includes preparing a metal foil made of amorphous soft magnetic material and applying heat treatment to the metal foil made of amorphous soft magnetic material to crystallize the amorphous soft magnetic material into nano-crystal soft magnetic material, thereby producing a metal foil.

Now, amorphous soft magnetic material and nano-crystal soft magnetic material forming metal foils will be described. Examples of the amorphous soft magnetic material and nano-crystal soft magnetic material include, but are not limited to, material containing at least one magnetic metal selected from the group consisting of Fe. Co, and Ni and at least one non-magnetic metal selected from the group consisting of B, C, P, Al, Si, Ti, V, Cr, Mn, Cu, Y, Zr, Nb, Mo, Hf, Ta, and W.

Typical examples of the amorphous soft magnetic material or nano-crystal soft magnetic material include, but are not limited to, a FeCo-based alloy (e.g., FeCo and FeCoV), a FeNi-based alloy (e.g., FeNi, FeNiMo, FeNiCr, and FeNiSi), a FeAl-based alloy or a FeSi-based alloy (e.g., FeAl, FeAlSi, FeAlSiCr, FeAlSiTiRu, and FeAlO), a FeTa-based alloy (e.g., FeTa, FeTaC, and FeTaN) or a FeZr-based alloy (e.g., FeZrN). A Fe-based alloy may contain at least 80 at % of Fe.

As another example of the amorphous soft magnetic material or nano-crystal soft magnetic material, a Co-based alloy containing Co and at least one of Zr, Hf, Nb, Ta, Ti, or Y may be used. The Co-based alloy may contain at least 80 at % of Co. Such a Co-based alloy is likely to become an amorphous state when it is deposited as a film, and exhibits excellent soft magnetism because it has small magnetocrystalline anisotropy and few crystal defects and grain boundaries. Examples of the amorphous soft magnetic material include CoZr, CoZrNb, and CoZrTa-based alloys.

The amorphous soft magnetic material as used herein is soft magnetic material having an amorphous structure as a main structure. In the amorphous structure, no clear peak appears in an X-ray diffraction pattern, and only a broad halo pattern can be observed. Meanwhile, a nano-crystal structure can be formed by applying heat treatment to the amorphous structure, and in a nano-crystal soft magnetic material having a nano-crystal structure, a diffraction peak can be observed in a position corresponding to a gap between lattice points on the crystal plane. Based on the width of the diffraction peak, the crystallite size can be calculated with the Scherrer equation.

In the nano-crystal soft magnetic material as used herein, each nano-crystal has a crystallite size of less than 1 μm as calculated with the Scherrer equation based on the full width at half maximum (FWHM) of a diffraction peak of an X-ray diffraction pattern. In the present embodiment, the crystallite size of each nano-crystal (the crystallite size as calculated with the Scherrer equation based on the full width at half maximum (FWHM) of a diffraction peak of an X-ray diffraction) may be equal to or less than 100 nm, or equal to or less than 50 nm. In addition, the crystallite size of each nano-crystal may be equal to or greater than 5 nm. If nano-crystals have a crystallite size within such a range, magnetic properties can be improved. Meanwhile, the crystallite size of a conventional electromagnetic steel sheet is of the order of μm, and typically equal to or greater than 50 μm.

The amorphous soft magnetic material can be obtained by, for example, melting metal material, which has been prepared to have the above-mentioned composition, at a high temperature in a high-frequency melting furnace or the like to obtain a uniform molten metal and quenching the result. The quenching rate is, for example, about $10^{6\circ}$ C./sec, though it depends on the material used. However, the quenching rate is not particularly limited as long as an amorphous structure can be obtained before the material crystallizes. In the present embodiment, the metal foil as will be described later can be obtained by blowing the molten metal of the metal material onto a rotating cooling roll to produce a metal foil strip made of amorphous soft magnetic material and forming the strip into a desired shape by punching, for example. In this manner, quenching a molten metal can obtain soft magnetic material having an amorphous structure before the material crystallizes. The metal foil may have a thickness within the range from 10 μm to 100 μm, for example, particularly within the range from 20 μm to 50 μm.

It should be noted that in the drawings as will be described later, a metal foil 10 has a rectangular shape, but the shape of the metal foil 10 is not limited to this. For example, the metal foil may be a fan-shaped metal foil according to the shape of a rotor core of a motor. The metal foil 10 is formed from an amorphous soft magnetic material strip by punching, for example. Such forming may cause the metal foil 10 to be warped as shown in FIG. 1. Heating the warped metal foil 10 with a heating device 1 shown in FIG. 1 can suitably produce the metal foil 10 made of nano-crystal soft magnetic material.

2. Heating Device 1 for Heating Metal Foil 10

The heating device 1 is configured to heat the metal foil 10 and includes a base (mount) 2 on which the metal foil 10 is placed, a suction device 3 configured to suck the metal foil 10 placed on the base 2, and a plurality of heaters 5, 5, . . . configured to heat the metal foil 10 via the base 2.

In some embodiments, the base 2 is made of material having a higher thermal conductivity than that of the metal foil 10 to be heated. When the metal foil 10 is made of a Fe-based amorphous alloy, the metal foil 10 may be made of metal material such as an aluminum alloy or a copper alloy, for example. The base 2 includes a placement surface 21 on which the metal foil 10 is placed. In the present embodiment, the placement surface 21 is flat. However, the shape of the placement surface 21 is not particularly limited as long as it is according to the shape of the metal foil 10 to be heated.

In the present embodiment, the placement surface 21 includes a plurality of suction ports 22, 22, . . . which is in communication with each other by a suction channel 23 formed inside of the base 2. The suction channel 23 connects to the suction device 3 via a pipe 8, at an end opposite to the end connecting to the suction ports 22, 22, 22, . . . . The suction device 3 may be a suction pump for example, or may be configured to use an aspirator (not illustrated), for example, to suck the metal foil 10 by decompression of the inside of the pipe 8 and the suction channel 23.

Figure 2:
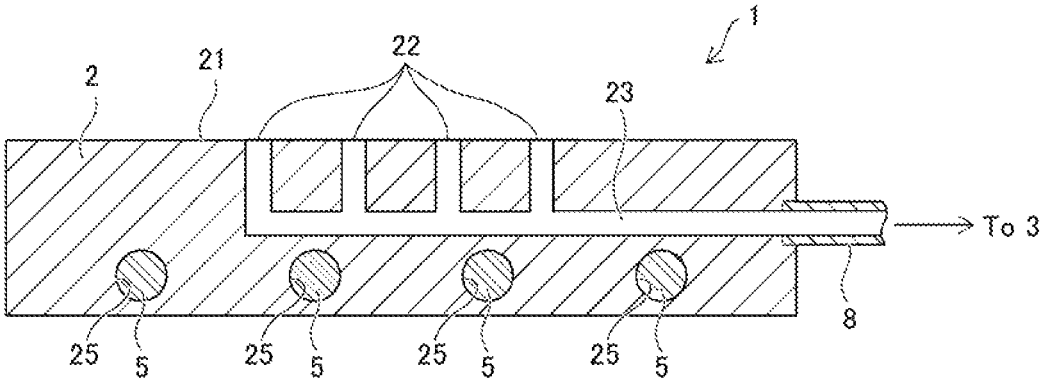
FIG. 2 is a cross-sectional view of the heating device of FIG. 1 as viewed in the direction of arrow along the line A-A.

As shown in FIG. 2, the base 2 includes housing portions 25 each being configured to house a heater 5. In the present embodiment, the housing portion 25 is disposed opposite to the placement surface 21 with respect to the suction channel 23. In the present embodiment, the heater 5 is a rod-shaped heater 5, and thus the housing portion 25 is a cavity extending in one direction and opening at one end. The heater 5 is inserted into the housing portion 25 of the base 2 from the opening.

In the present embodiment, the heater 5 is a rod-shaped heater of an electrical resistance heating type and connects to a power source (not illustrated) via a wire 51. The heater 5 is embedded in the base 2. Specifically, the heater 5 is housed in the housing portion 25 of the base 2. Although the heater 5 is a rod-shaped heater in the present embodiment, the shape of the heater 5 is not particularly limited as long as the placement surface 21 of the base 2 can be uniformly heated. The heater 5 may be a sheet-like heater.

Furthermore, although the base 2 and the metal foil 10 are heated by electrical resistance of the heater 5 in the present embodiment, the base 2 and the metal foil 10 may be heated by induction heating or heating with a heating medium, for example. In addition, the heater 5 may be provided outside of the base 2 and may heat the base 2 from the outside.

3. Method for Producing Metal Foil 10

The metal foil 10 is heated using the heating device 1 shown in FIG. 1 and FIG. 2. Firstly in the present embodiment, the metal foil 10 made of amorphous soft magnetic material is placed on the placement surface 21 of the base 2 made of metal. At this time, the metal foil 10 is placed so as to cover the suction ports 22, 22, . . . formed on the placement surface 21.

Figure 3:
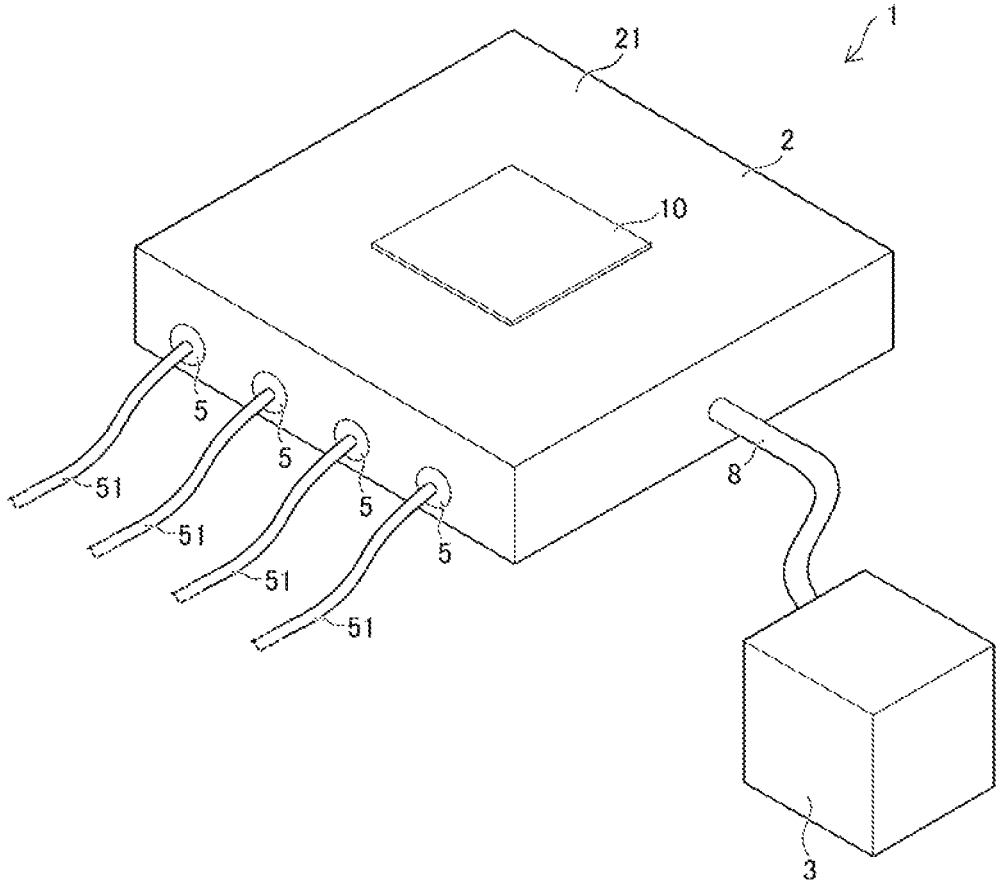
FIG. 3 is a schematic perspective view of the heating device of FIG. 1 showing a state where a metal foil is in close contact with the heating device.

Next, the metal foil 10 made of amorphous soft magnetic material is brought into close contact with the placement surface 21 of the base 2 to conform to the placement surface 21. Specifically, after the placement of the metal foil 10, the suction device 3 is operated. This makes the inside of the pipe 8 and the suction channel 23 decompressed, and allows the metal foil 10 to be sucked from the plurality of suction ports 22, 22, . . . . In the present embodiment, the metal foil 10 is sucked from the plurality of suction ports 22, 22 . . . so that as shown in FIG. 3, for example, the warped metal foil 10 conforms to the flat placement surface 21 to correct its warping, allowing the metal foil 10 to be in close contact with the placement surface 21 of the base 2. In addition, even if the placement surface 21 of the base 2 has, for example, foreign matter or the like thereon, the foreign matter may be sucked from the suction port 22. This can prevent the foreign matter from entering the space between the metal foil 10 and the base 2.

Next, the metal foil 10 in a state of being in close contact with the base 2 is heated to crystallize the amorphous soft magnetic material of the metal foil 10 into nano-crystal soft magnetic material. Specifically, the metal foil 10 is heated at a heating temperature that is higher than or equal to a crystallization starting temperature at which the amorphous soft magnetic material crystallizes into nano-crystal soft magnetic material and that allows the temperature of the placement surface 21 to be lower than the surface temperature of the metal foil 10 having temperature rise due to heat generated by self-heating during crystallization. This configuration allows the amorphous soft magnetic material of the metal foil 10 to crystallize into nano-crystal soft magnetic material and also allows the base 2 to absorb the heat of the metal foil 10 generated by self-heating during crystallization.

Herein, as long as the material can be crystallized and the heat of the metal foil 10 generated by itself can be absorbed by the base 2, the conditions of heat treatment of the metal foil 10 are not particularly limited, and may be appropriately selected in consideration of the composition of metal material and the desired magnetic properties to be obtained, for example. The heat treatment may be performed in an inert gas atmosphere.

Herein, the lower limit of the heating temperature for heating the metal foil 10 is the crystallization starting temperature at which crystallization of the amorphous soft magnetic material into nano-crystal soft magnetic material begins. The term "crystallization starting temperature" means a temperature at which crystallization occurs in the amorphous soft magnetic material.

Since exothermic reaction occurs during crystallization, the crystallization starting temperature may be determined by measuring the temperature at which heat is generated along with the crystallization of the metal foil 10. For example, the crystallization temperature can be measured under the condition of a predetermined heating rate (e.g., 0.67 $Ks^{-1}$) using differential scanning calorimetry (DSC). The crystallization starting temperature of the amorphous soft magnetic material is, for example, within the range from 400 to 450° C., when the material is a Fe-based amorphous alloy, though it differs depending on the material used.

Herein, when the temperature of the metal foil 10 rises due to the heat transmitted from the placement surface 21, from an ambient temperature to a temperature below the crystallization starting temperature, the metal foil 10 retains, as sensible heat, an amount of heat $mc\Delta T$, where m is a mass of the metal foil 10, c is a specific heat of the material of the metal foil 10, and $\Delta T$ is a range of the temperature rise. In addition, an amount of heat $\Delta Qout$, which is part of the input heat, is dissipated from the exposed surface of the metal foil 10. It should be noted that the symbol "Δ" as used herein means a unit time.

Figure 4:
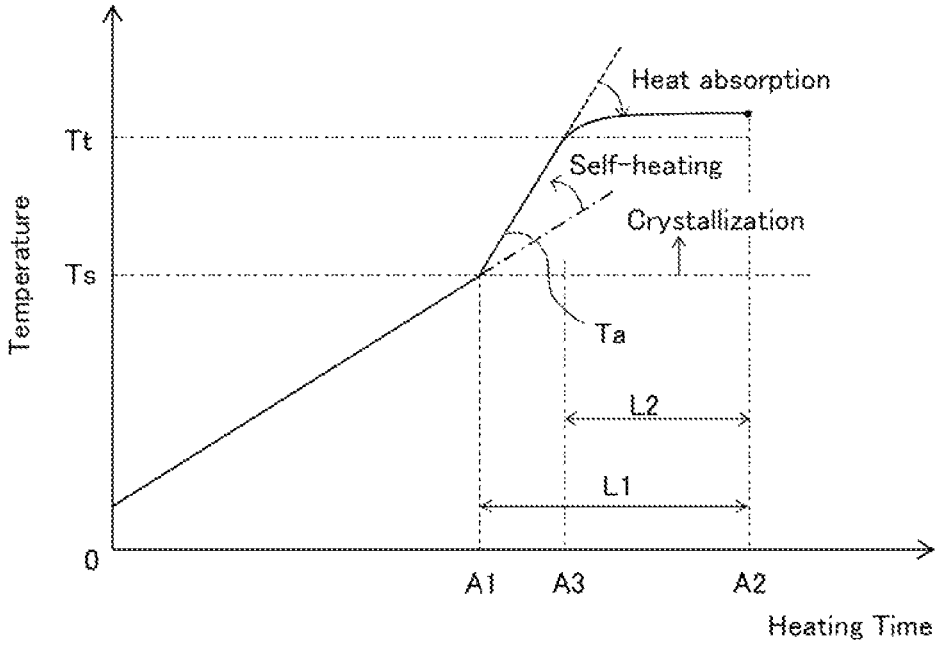
FIG. 4 is a graph showing a temperature profile of the metal foil of FIG. 3.

As shown in FIG. 4, when the metal foil 10 is heated to a crystallization starting temperature Ts or higher, the metal foil 10 generates heat by itself during crystallization. At this time, an amount of heat ΔQself is generated in the metal foil 10 due to the heat generated by itself.

For example, when the heating temperature of the base 2 (specifically, the temperature of the placement surface 21) Tt is set equal to the crystallization starting temperature Ts, the metal foil 10 generates heat by itself. This generates the amount of heat ΔQself due to the heat of the metal foil 10 generated by itself and raises the temperature of the metal foil 10 to a temperature higher than the crystallization starting temperature Ts, thereby increasing the rate of the temperature rise of the metal foil 10.

In such a case, a temperature Ta of the metal foil 10 is higher than the temperature of the placement surface 21 of the base 2 (heating temperature Tt). Therefore, although the base 2 is being heated by the heater 5, the heat generated by self-heating of the metal foil 10 as a heat source is absorbed by the base 2 via the placement surface 21.

In addition, when the temperature of the placement surface 21 of the base 2 (specifically, the heating temperature Tt) is set higher than the crystallization starting temperature Ts, the metal foil 10 begins to generate heat by itself at the point when its temperature reaches the crystallization starting temperature Ts or higher. This generates the amount of heat ΔQself due to the heat of the metal foil 10 generated by itself.

Herein, the temperature of the metal foil 10 further rises according to the amount of heat ΔQself by self-heating at a timing when the temperature of the metal foil 10 reaches the crystallization starting temperature Ts or higher. When the heating temperature Tt is higher than the temperature Ta of the metal foil 10 during self-heating, heat continues to be input to the metal foil 10 via the placement surface 21. Then, in such a case, the heat of the metal foil 10 generated by itself cannot be absorbed by the base 2 via the placement surface 21.

In view of the above, the upper limit of the heating temperature Tt (the temperature of the placement surface 21) for heating the metal foil 10 is set lower than the temperature Ta of the metal foil 10 having temperature rise due to heat generated by self-heating during crystallization, in a state where the metal foil 10 is placed on the base 2. The upper limit of the heating temperature Tt may be, for example, higher than the above-mentioned crystallization starting temperature Ts by 30 to 100° C. when the material is a Fe-based amorphous alloy, though it differs depending on the material used.

By setting the heating temperature Tt within such a range, the temperature Ta of the metal foil 10 during self-heating is higher than the crystallization starting temperature Ts, and is higher than the heating temperature Tt in a time period L2 within a time period L1 in which the metal foil 10 is heated at the heating temperature Tt, which is higher than or equal to the crystallization starting temperature Ts. That is, within the time period L1 from the time A1 when the temperature Ta of the metal foil 10 reaches the crystallization starting temperature Ts to the time A2 when the crystallization of the metal foil 10 ends, the time period U from the time A3 when the temperature Ta of the metal foil 10 exceeds the heating temperature Tt to the time A2 when the crystallization of the metal foil 10 ends is a period in which the heat of the metal foil 10 generated by itself is absorbed by the base 2. It should be noted that the time A2 when the crystallization of the metal foil 10 ends is a time when the nano-crystals of the metal foil 10 have a predetermined crystallite size.

The temperature of the metal foil 10 having temperature rise due to heat generated by itself may be calculated using a typical heat calculator based on the amount of heat input to the metal foil 10, the amount of sensible heat retained in the metal foil 10, the amount of heat dissipated from the surface of the metal foil 10, the amount of heat of the metal foil 10 generated by itself, the amount of heat of the metal foil 10 absorbed via the placement surface 21, a contact resistance of heat between the metal foil 10 and the placement surface 21, and the like. Alternatively, the temperature of the metal foil 10 having temperature rise due to heat generated by itself may be obtained by experiments including actually changing the heating temperature Tt of the placement surface 21.

As described above, the time period L1 in which the metal foil 10 is heated at the heating temperature Tt higher than or equal to the crystallization starting temperature Ts may include the time period L2 in which the temperature Ta of the metal foil 10 during self-heating is higher than the heating temperature Tt. This configuration allows the base 2 to absorb the heat generated by the metal foil 10 in the time period L2, in which the amount of heat of the metal foil 10 absorbed via the placement surface 21 is larger than the amount of heat of the metal foil 10 generated by itself.

According to the above-described present embodiment, the metal foil 10 in a state of being in close contact with the placement surface 21 of the base 2 is heated to crystallize the amorphous soft magnetic material of the metal foil 10 into nano-crystal soft magnetic material. At this time, by setting the heating temperature Tt within the above-described range, the amorphous soft magnetic material of the metal foil 10 can be crystallized and the base 2 can absorb the heat of the metal foil 10 generated by itself via the placement surface 21 of the base 2.

Since the metal foil 10 is in close contact with the base 2, the heat of the metal foil 10 is uniformly absorbed by the base 2, and the metal foil 10 has a uniform temperature during crystallization. Thus, the crystals of the metal foil 10 can be crystallized into uniformly-sized crystals. Consequently, it is possible to suppress decrease in the magnetic properties of the metal foil 10 due to variation in size of the crystals (specifically, generation of coarse crystals).

In particular, the present embodiment heats the metal foil 10 with the heaters 5 embedded in the base 2, and thus it is possible to uniformly heat the placement surface 21 of the base 2 with the heaters 5 embedded in the base 2 and also uniformly heat the metal foil 10 with the heat generated by the heating. In addition, the temperature of the placement surface 21 is lower than the temperature of the self-heated metal foil 10 during crystallization and the placement surface 21 has a uniform temperature, and thus the base 2 can uniformly absorb the heat of the metal foil 10 generated by itself via the placement surface 21.

Figure 5A:
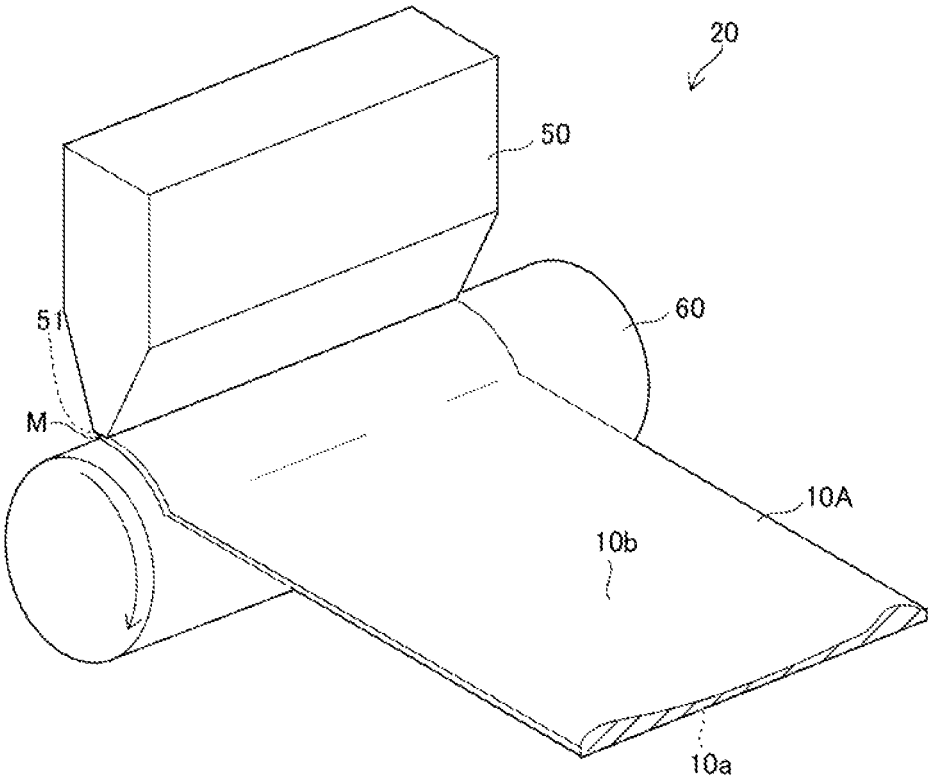
FIG. 5A is a schematic perspective view for explaining a preparing step in the method for producing metal foils according to a modification.

Herein, the metal foil 10 may be prepared beforehand by using a forming device 20 shown in FIG. 5A. This configuration is mentioned above, but the details thereof will be briefly described below with reference to FIG. 5A. In the present embodiment, the forming device 20 includes a crucible 50 and a columnar cooling roll 60 and forms a metal foil 10 by melt-quenching. Examples of the melt-quenching include a single-roll method, a twin-roll method, or a centrifugation method, for example. From the productivity and maintenance perspectives, the present embodiment employs the single-roll method, which supplies a molten metal M onto a single cooling roll 60 rotating at high speed and obtains a metal foil strip 10A by rapid solidification of the molten metal M.

The crucible 50 shown in FIG. 5A includes a high-frequency heater (not illustrated). The forming device 20 uses the high-frequency heater to heat the metal, which is an initial material of the metal foil 10, and produces the molten metal M. The composition of the molten metal M is described above. The crucible 50 as used herein corresponds to the above-mentioned high-frequency melting furnace.

An ejection opening 51, from which the molten metal M in the crucible 50 is ejected, is formed on the underside of the crucible 50. The ejection opening 51 has a slit shape and is disposed facing the circumferential surface of the cooling roll 60 to extend in the axial direction of the cooling roll 60. The cooling roll 60 is made of copper, connected to a motor (not illustrated) to rotary drive. The cooling roll 60 includes a cooling mechanism through which a coolant flows. It should be noted that a pressure adjusting device (not illustrated) is provided upstream of the crucible 50 to adjust an amount of the molten metal M ejected from the ejection opening (ejection amount).

To produce the metal foil 10, the molten metal M obtained by melting the material of the metal foil 10 is blown onto the circumferential surface of the rotating cooling roll 60 and then the molten metal M is cooled and solidified on the circumferential surface of the cooling roll 60. By quenching the molten metal M on the cooling roll 60, a metal foil strip 10A made of amorphous soft magnetic material can be obtained without crystallization of the molten metal M. The thus-obtained metal foil strip 10A is formed into a desired shape through cutting, punching, and the like. Then, the obtained metal foil 10 is heated by the heating device 1 and the like as shown in FIG. 1, for example.

Figure 5B:
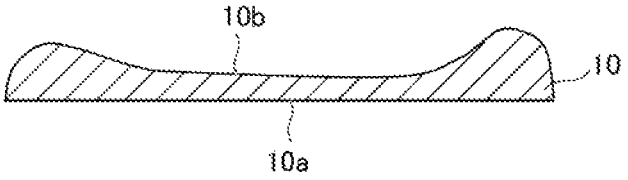
FIG. 5B is a schematic cross-sectional view of the metal foil produced in FIG. 5A.

Herein, as shown in FIG. 5A and FIG. 5B, the surface 10*a*, which is in contact with the cooling roll 60, of the surfaces of the obtained metal foil 10A (10) is flat according to the shape of the surface of the columnar cooling roll 60. Meanwhile, the surface 10*b*, which is opposite to the surface 10*a* in contact with the cooling roll 60, of the surfaces of the obtained metal foil 10 has unevenness due to the variation in amount of the molten metal M adhering to the cooling roll 60. Then, the present embodiment uses the heating device 1A to heat the metal foil 10 as shown in FIG. 6A and FIG. 6B.

Figure 6A:
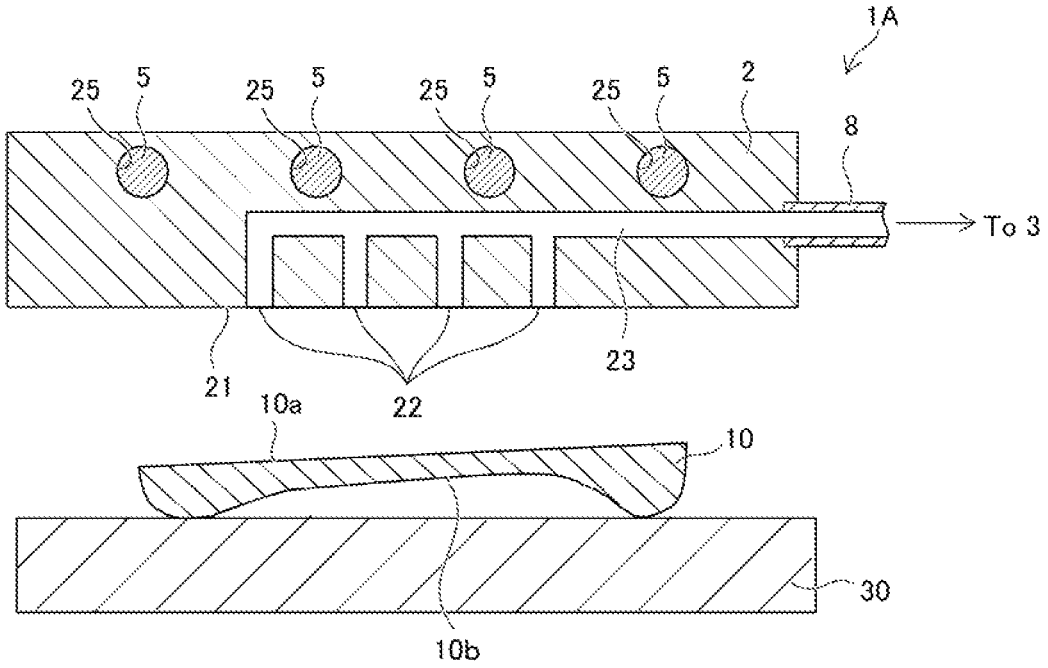
FIG. 6A is a schematic cross-sectional view for explaining a crystallization step of a metal foil using the heating device of FIG. 1.
Figure 6B:
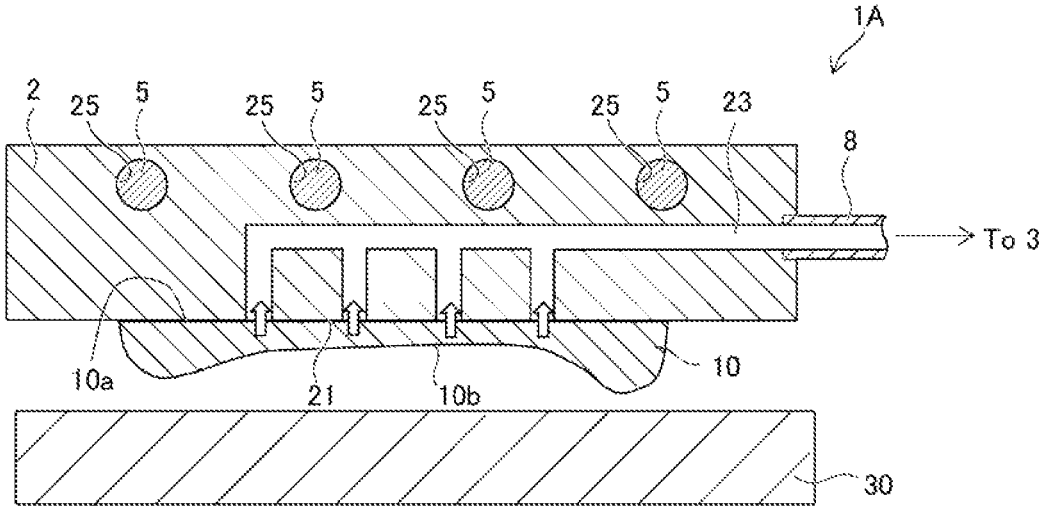
FIG. 6B is a schematic cross-sectional view for explaining a state where the metal foil is heated while adsorbed on a placement surface of a base.

The heating device 1A shown in FIG. 6A and FIG. 6B is the same as the heating mechanism shown in FIG. 1 and FIG. 2. In the heating device 1A shown in FIG. 6A and FIG. 6B, the placement surface 21 of the base 2 is vertically reversed so as to face down as compared to the heating mechanism shown in FIG. 1 and FIG. 2. The heating device 1A further includes a support member 30 at a position facing the placement surface 21 of the base 2. The heating device 1A also includes a moving device (not illustrated) attached to the base 2 and the support member 30 for moving at least one of the base 2 or the support member 30 to bring them close to or separated from each other.

In the present embodiment, as shown in FIG. 6A and FIG. 6B, when the metal foil 10 is brought into close contact with the base 2, the surface 10*a*, which was in contact with the cooling roll 60, of the surfaces of the metal foil 10 is brought into close contact with the placement surface 21. Specifically, as shown in FIG. 6A, the present embodiment disposes the metal foil 10 on the support member 30 such that the surface 10*a* of the metal foil 10 faces the base 2. That is, the present embodiment disposes the metal foil 10 on the support member 30 such that the surface 10*b*, which is opposite to the surface 10*a* of the metal foil 10, is in contact with the support member 30.

Next, as shown in FIG. 6B, at least one of the base 2 or the support member 30 is moved to bring the base 2 and the support member 30 close to each other to the position where the metal foil 10 can be sucked from the plurality of suction ports 22, 22, . . . . That is, in the present embodiment, the metal foil 10 is not sandwiched between the base 2 and the support member 30. This configuration will not correct the shape of the metal foil 10 by the base 2 and the support member 30 but corrects the shape of the metal foil 10 with suction by the plurality of suction ports 22, 22, . . . . The metal foil 10 is not pressurized by the base 2 and the support member 30, and the opposite surface 10*b* of the metal foil 10 is exposed to the atmosphere. This can prevent the metal foil 10 from not being uniformly heated due to variation in pressure distribution for pressurizing the metal foil 10, for example.

Figure 7:
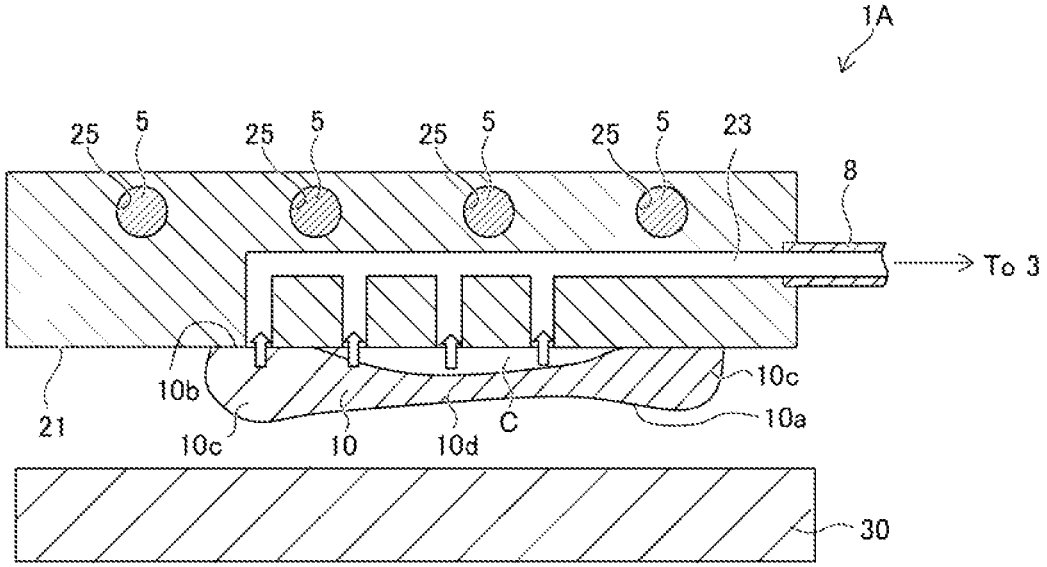
FIG. 7 is a schematic cross-sectional view of a comparison of FIG. 6B.

By the way, as shown in FIG. 7 for example, when the opposite surface 10*b* of the metal foil 10 is brought into close contact with the placement surface 21 of the base 2, the surface 10*b* may not come into close contact uniformly (i.e., part of the surface 10*b* may heave up) during the process, thought it depends on the unevenness of the surface 10*b*. The heat of the base 2 advances crystallization from a portion 10*c* in close contact with the placement surface 21, and causes the portion 10*c* to contract. Thereafter, the heat of the base 2 causes a portion 10*d*, which is partly not in close contact with the placement surface 21 with a gap C, to crystallize and contract. Such non-uniform contraction by the crystallization may cause non-uniform plastic deformation of the metal foil. It should be noted that the portion 10*d*, which is partly not in close contact with the placement surface 21, comes into close contact with the base 2 after the portion 10*c*, which is in close contact with the placement surface 21.

However, since the surface 10*a*, which was in contact with the cooling roll 60, of the surfaces of the metal foil 10 is flat, and by bringing the surface 10*a* into close contact with the placement surface 21 of the base 2 as shown in FIG. 68, the metal foil 10 can be brought into close contact with the placement surface 21 uniformly. Thus, as compared to the example shown in FIG. 7, the metal foil 10 can be uniformly heated and crystallized. Consequently, this facilitates the uniform crystallization of the metal foil 10, prevents non-uniform plastic deformation of the metal foil 10 caused by distortion along with the contraction during crystallization, and thus can laminate the crystallized metal foils 10 more precisely. It should be noted that when the heating device 1 of FIG. 1 is used, the surface 10*a* of the metal foil 10 may be disposed on the placement surface 21 of the base 2.

Figure 6C:
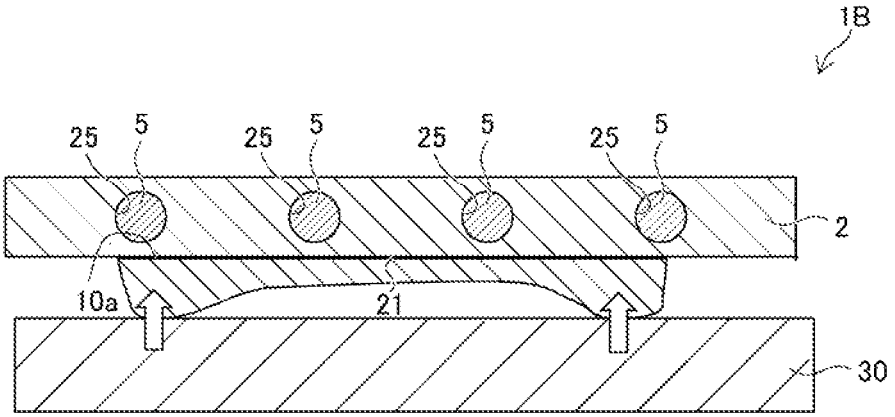
FIG. 6C is a schematic cross-sectional view of a modification of FIG. 6B.

Furthermore, a heating device 1B shown in FIG. 6C may be used in the crystallization step. The base 2 of the heating device 1B does not include a suction port, but has the heaters 5 embedded therein as in FIG. 6A. In addition, the heating device 1B includes a moving device (not illustrated) coupled to at least one of the base 2 or the support member 30 for moving the base 2 and the support member 30 in a direction to bring them close to each other to the position where the metal foil 10 can be sandwiched between the base 2 and the support member 30.

The present embodiment disposes the metal foil 10 on the support member 30 and moves the base 2 and the support member 30 in a direction to bring them close to each other, so that the metal foil 10 is sandwiched between the base 2 and the support member 30. This configuration brings the metal foil 10 into close contact with the base 2 and heats the metal foil 10 by the heaters 5 embedded in the base 2.

Herein, either of the surfaces of the metal foil 10 may be brought into contact with the base 2 as long as the metal foil 10 can be uniformly heated. However, when the above-mentioned single-roll method is used to produce a metal foil 10, the surface 10*a*, which was in contact with the cooling roll 60, of the metal foil 10 may be brought into close contact with the placement surface 21 for the same reason as the one stated above.

In addition, although the heating device 1 shown in FIG. 1 includes the suction ports in the base 2, the heating device 1B shown in FIG. 6C for example may include the suction ports of FIG. 1 in either the base 2 or the support member 30 for sucking the metal foil 10. When the suction ports are provided in the support member 30, deformation of the metal foil 10 such as warping may be corrected with suction from the suction ports at a stage when the metal foil 10 is placed on the support member 30. Meanwhile, when the suction ports are provided in the base 2, bringing the support member 30, on which the metal foil 10 is placed, close to the base 2 causes the metal foil 10 to be adsorbed on the placement surface 21 of the base 2, and the adsorbed metal foil 10 is sandwiched and pressurized by the support member 30.

Herein, whichever surface of the surfaces of the metal foil 10 is brought into contact with the base 2, heating of the metal foil 10 by the heating device 1B shown in FIG. 6C may cause the metal foil 10 to be non-uniformly heated if the shape of the metal foil 10 is slightly warped or rolled. In view of this, as will be clearly seen from the experiments described later, the inventors have found the following:

Specifically, when the heating device 1B shown in FIG. 6C is used, the following condition (i) or condition (ii) may be satisfied in the crystallization step.

(i) The material of the support member 30 has a thermal conductivity of 0.2 W/mK or lower.

(ii) The support member 30 has a temperature of 300° C. or higher and lower than the crystallization starting temperature.

The metal foil 10 is heated by the heaters 5 embedded in the base 2 to crystallize in a state where the metal foil 10 is sandwiched between the base 2 and the support member 30. When the condition (i) the material of the support member 30 has a thermal conductivity of 0.2 W/mK or lower, is satisfied, heat is less likely to be absorbed by the support member 30.

Specifically, even if deviation for example occurs in temperature distribution of the placement surface 21 of the base 2 upon close contact with the metal foil 10, due to the shape of the metal foil 10 such as rolling (waving) or warping through punching, cutting, and the like, the heat of the metal foil 10 is less likely to be absorbed by the support member 30. This can easily retain the heat between the metal foil 10 and the support member 30, and thus the temperature distribution of the metal foil 10 tends to become uniform.

This can prevent the temperature of the placement surface 21 of the base 2 from locally decreasing in a state where the metal foil 10 is in close contact with the base 2. Consequently, this facilitates the uniform crystallization of the metal foil 10, prevents non-uniform plastic deformation of the metal foil 10 caused by distortion along with the contraction during crystallization, and thus can laminate the crystallized metal foils 10 more precisely.

Herein, as can be clearly seen from the examples described later, when the material of the support member 30 has a thermal conductivity higher than 0.2 W/mK, the heat of the placement surface 21 of the base 2 tends to escape to the support member via the metal foil. Thus, even if deviation for example occurs in temperature distribution of the placement surface 21 of the base 2 upon close contact with the metal foil 10, the deviated temperature distribution is less likely to become uniform and since the crystallization of the metal foil 10 begins from a high-temperature portion thereof, the metal foil 10 contracts along with crystallization at different timings depending on the portions. As a result, the metal foil 10 may have non-uniform plastic deformation, and the crystallized metal foils 10 may not be laminated precisely.

Herein, examples of the material of the support member 30 that satisfies the condition of a thermal conductivity of 0.2 W/mK or lower include calcium silicate, calcium sulphate, or a resin such as PVC or acrylic resin.

Meanwhile, when the metal foil 10 is heated by the heaters 5 embedded in the base 2 to crystallize, even if the condition (ii) the support member 30 has a temperature of 300° C. or higher and lower than the crystallization starting temperature of the metal foil, is satisfied, the heat of the base is less likely to be absorbed by the support member because the base 2 and the support member 30 has a small temperature difference therebetween.

Specifically, even if deviation for example occurs in temperature distribution of the placement surface 21 of the base 2 upon close contact with the metal foil 10, due to the shape of the metal foil 10 such as warping, the heat of the metal foil 10 is less likely to be absorbed by the support member 30 and the temperature distribution of the metal foil 10 tends to become uniform.

This can prevent the temperature of the placement surface 21 of the base 2 from locally decreasing in a state where the metal foil 10 is in close contact with the base 2. Consequently, this facilitates the uniform crystallization of the metal foil 10, prevents non-uniform plastic deformation of the metal foil 10 caused by distortion along with the contraction during crystallization, and thus can laminate the crystallized metal foils 10 more precisely.

Herein, as can be clearly seen from the examples described later, when the support member 30 has a temperature lower than 3) ° C., the heat of the placement surface 21 of the base 2 tends to escape to the support member via the metal foil 10. Thus, if variation occurs in temperature of the placement surface 21, the level of crystallization of the metal foil 10 varies depending on the portions according to such temperature variation, and this causes the metal foil 10 to contract along with crystallization at different timings depending on the portions. As a result, the metal foil 10 may have non-uniform plastic deformation, and the crystallized metal foils 10 may not be laminated precisely. Meanwhile, when the support member 30 has a temperature higher than or equal to the crystallization starting temperature of the metal foil 10, crystallization may occur in the metal foil 10 when the metal foil 10 is disposed on the support member 30 (that is, before the metal foil is sandwiched between the base 2 and the support member 30), and the effect of crystallization of the metal foil 10 by the heat of the base 2 may not be produced.

When the heating device 1B shown in FIG. 6C is used in the crystallization step, the following condition may further be satisfied. Specifically, in the crystallization step, the metal foil 10 is sandwiched between the base 2 and the support member 30 by moving at least one of the base 2 or the support member 30 in a direction to bring them close to each other at a moving speed of 125 mm/s or higher. This can instantly bring the metal foil 10 into contact with the placement surface 21 of the base 2, and can heat the portions of the metal foil 10 at approximately the same timing by the placement surface 21 of the base 2. Consequently, this can uniformly heat the metal foil 10, and thus can facilitate the uniform crystallization of the metal foil 10 and prevent non-uniform plastic deformation of the metal foil 10 along with the contraction during crystallization. Therefore, the crystallized metal foils 10 can be laminated more precisely.

Herein, when the moving speed between the base 2 and the support member 30 is lower than 125 mms, the metal foil 10 may have a portion that begins to be locally heated upon contact with the base 2 at a different timing compared to the other portions, and this may cause the metal foil 10 to contract along with crystallization at different timings depending on the portions. Consequently, the metal foil 10 may have non-uniform plastic deformation, and the crystallized metal foils 10 may not be laminated precisely.

In the present embodiment, although the metal foil 10 having a rectangular shape is produced, when a stator of a motor is produced for example, a metal foil having a fan shape for a stator core divided in the circumferential direction around the rotation axis of the motor may be prepared, and the result may be heated to produce metal foils made of nano-crystal soft magnetic material. Next, the metal foils 10 are brought into close contact with each other with a predetermined pressure to form a laminate 10A. At this time, the metal foils 10 may be tied to each other with a resin such as an adhesive, for example.

Figure 8A:
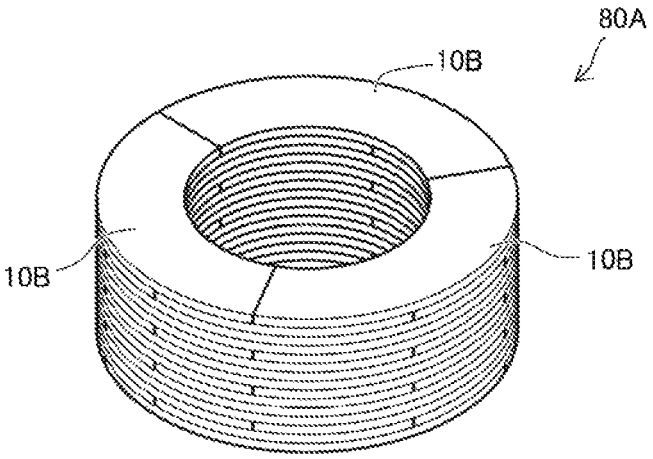
FIG. 8A is a schematic perspective view for explaining a step of producing a rotor core.

Furthermore, as shown in FIG. 8A, a plurality of such laminates 10B is stacked in the state of a stator core and fixed, whereby a stator core 80A is produced. It should be noted that the detailed shape of teeth of the stator core and the like are omitted in FIG. 8A and FIG. 8B.

Figure 8B:
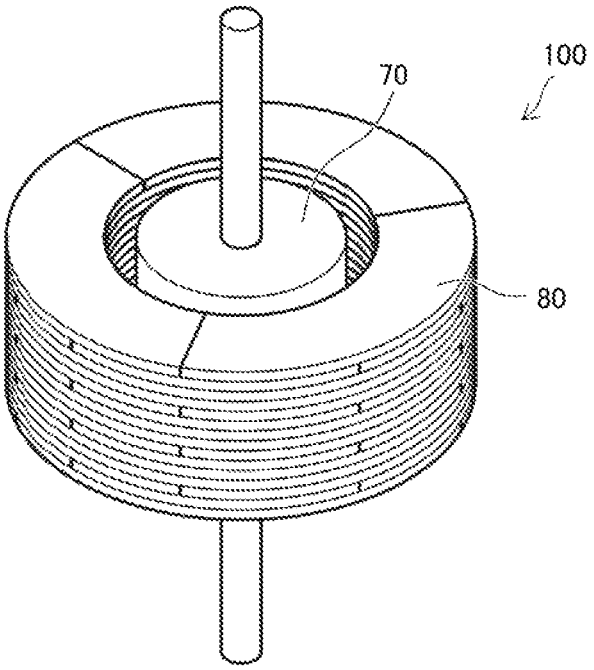
FIG. 8B is a schematic perspective view for explaining a step of producing a motor.

Finally, an assembling step is performed as shown in FIG. 8B. In this step, a coil (not illustrated) is disposed on teeth (not illustrated) of the stator core to form a stator 80, and the stator 80 and a rotor 70 are disposed in a case (not illustrated), whereby a motor 100 is produced.

EXAMPLES

Now, the method for producing metal foils according to the present embodiment will further be described in detail with examples and comparative examples.

Example 1

First, a metal foil (NANOMET available from Tohoku Magnet Institute) made of amorphous soft magnetic material (Fe-based amorphous alloy) having a thickness of 25 μm obtained by a typical process was prepared. This metal foil has a crystallization starting temperature of 419.19° C. The metal foil was brought into close contact with the surface of a hot plate, which was heated to 500° C., for 1 second. That is, the heating temperature of the metal foil is 500° C. The thus-obtained metal foil was crystallized into nano-crystal soft magnetic material, and had a saturation flux density within the range from 1.76 to 1.73 T and a coercive force within the range from 8 to 10 A/m.

Comparative Example 1

A metal foil was produced by the same process as in Example 1. The difference from Example 1 was that the metal foil was heated without suction in a state where part of the metal foil was not in contact with the hot plate. The thus-obtained metal foil was crystallized into nano-crystal soft magnetic material, but the portion not in contact with the hot plate had an excessive temperature rise in the metal foil and had coarse crystals. The metal foil had a saturation flux density of 1.74 T and a coercive force of 3751 A/m. Use of the metal foil with such properties for a motor may result in a large loss of torque.

As described above, in Comparative Example 1, it is assumed that the portion of the metal foil not in contact with the hot plate had a temperature rise to about 800° C. by the heat of the metal foil generated by itself. As a result, it is assumed that fine crystals were not produced, unlike the metal foil of Example 1, resulting in a higher coercive force than that in Example 1.

Example 2-1

A metal foil was heated as in Example 1. Specifically, first, a metal foil strip 10A made of amorphous soft magnetic material (Fe-based amorphous alloy, specifically Fe—Ni—B based amorphous alloy) having a thickness of 25 μm was prepared by using the forming device 20 shown in FIG. 5A. From the obtained metal foil strip 10A, a plurality of metal foils 10 having a ring shape with an outer diameter of 50.4 mm and an inner diameter of 30 mm was punched. Next, as shown in FIG. 6B, the metal foil 10 was heated while the surface 10*a* having been in contact with the cooling roll 60 was brought into close contact with the placement surface 21 of the base 2, which was heated to 500° C., to produce a plurality of metal foils 10 made of nano-crystal soft magnetic material. A laminate was produced by stacking 400 pieces of the metal foils 10. The thickness of the laminate was measured as a dimension in the laminated direction of the laminate, and the measured thickness of the laminate was divided by the thickness of the laminate with a density of 100%. The result multiplied by 100 was obtained as a space factor of the laminate. The space factor is shown in Table 1.

Example 2-2

A laminate was produced by the same process as in Example 2-1. The difference from Example 2-1 was that the metal foil 10 was heated by the heating device 1B as shown in FIG. 6C. It should be noted that in Example 2-2, a plurality of suction ports was provided in the steel support member 30 for sucking the metal foil 10, and the metal foil 10 was sandwiched between the support member 30 and the base 2 while the shape of the metal foil 10 was corrected. A space factor of the obtained laminate was calculated as in Example 2-1. The result is shown in Table 1. It should be noted that in Example 2-2, the metal foil 10 was heated while the surface 10*a* having been in contact with the cooling roll 60 was brought into close contact with the placement surface 21 of the base 2.

Example 2-3

A laminate was produced by the same process as in Example 2-1. The difference from Example 2-1 was that the metal foil 10 was heated while the surface 10*b* not having been in contact with the cooling roll 60 was brought into close contact with the placement surface 21 of the base 2 as shown in FIG. 7. A space factor of the obtained laminate was calculated as in Example 2-1. The result is shown in Table 1.

Example 2-41

A laminate was produced by the same process as in Example 2-2. The difference from Example 2-2 was that the metal foil 10 was heated by the heating device 1B shown in FIG. 6C while the surface 10*b* not having been in contact with the cooling roll 60 was brought into close contact with the placement surface 21 of the base 2. A space factor of the obtained laminate was calculated as in Example 2-1. The result is shown in Table 1.

TABLE 1

| | Space factor of laminate |
|---|---|
| Example 2-1 | 96.5% |
| Example 2-2 | 95.7% |
| Example 2-3 | 95.5% |
| Example 2-4 | 95.4% |

The space factor decreased in the order of Example 2-1 to Example 2-4. It is assumed that the laminate in Example 2-1 had the highest space factor because the surface 10*a* having been in contact with the cooling roll 60 was flat and was brought into close contact with the base 2 uniformly as a heat source. In addition, in Example 2-1, the surface 10*b* not having been in contact with the cooling roll 60 did not come into contact with material having a higher thermal conductivity than that of the atmosphere such as the support member, and was exposed to the atmosphere, and thus it is assumed that the heat from the base 2 was uniformly transmitted to the metal foil 10.

The space factor of the laminate in Example 2-2 was lower than that in Example 2-1 because it is assumed that the metal foil 10 was sandwiched between the base 2 and the support member 30, and this made the heat from the base 2 locally escape to the support member 30 via the metal foil 10 and made the heat transmission to the metal foil 10 non-uniform.

In addition, in Example 2-3 and Example 2-4, it is assumed that the surface (the surface having unevenness) 10*b*, not having been in contact with the cooling roll 60, of the metal foil 10 was brought into contact with the base 2 as a heat source, and this made the heat transmission to the metal foil 10 non-uniform. It is assumed that such non-uniform heat transmission caused distortion and plastic deformation of the metal foil 10 during crystallization, resulting in a low space factor of the laminate.

Example 3-1

A laminate was produced by the same process as in Example 2-1. In Example 3-1, the metal foil 10 was heated by the heating device 1B shown in FIG. 6C. Specifically, the metal foil 10 was sandwiched between the base 2 and the support member 30 by bringing the base 2 close to the support member 30 such that a relative moving speed between the base 2 and the support member 30 of the heating device 1B shown in FIG. 6C was 125 mm/s. The temperature of the support member 30 was an ambient temperature (within the range from 20° C. to 50° C.), and the material made of calcium silicate and having a thermal conductivity of 0.2 W/mK was used for the support member 30. The appearance of the metal foil 10 obtained by heating was confirmed, and a space factor of the obtained laminate was calculated as in Example 2-1. The results are shown in Table 2.

Example 3-2

A laminate was produced by the same process as in Example 3-1. The difference from Example 3-1 was that the metal foil 10 was sandwiched between the base 2 and the support member 30 by bringing the base 2 close to the support member 30 such that a relative moving speed between the base 2 and the support member 30 of the heating device 1B shown in FIG. 6C was 128 mm/s. Another difference was that the material made of glass fiber and cement and having a thermal conductivity of 0.4 W/mK was used for the support member 30. The appearance of the metal foil 10 obtained by heating was confirmed, and a space factor of the obtained laminate was calculated as in Example 2-1. The results are shown in Table 2.

Example 3-3

A laminate was produced by the same process as in Example 3-1. The difference from Example 3-1 was that the metal foil 10 was sandwiched between the base 2 and the support member 30 by bringing the base 2 close to the support member 30 such that a relative moving speed between the base 2 and the support member 30 of the heating device 1B shown in FIG. 6C was 128 mm/s. Another difference was that the material made of rolled steel for general structure (JIS standard: SS400) and having a thermal conductivity of 51.6 W/mK was used for the support member 30. The appearance of the metal foil 10 obtained by heating was confirmed. The results are shown in Table 2.

Example 3-4 to Example 3-7

A laminate was produced by the same process as in Example 3-3. Example 3-4 to Example 3-7 were different from Example 3-3 in that the metal foil 10 was sandwiched between the base 2 and the support member 30 by bringing the base 2 close to the support member 30 such that a relative moving speed between the base 2 and the support member 30 of the heating device 1B shown in FIG. 6C was 136 mm/s, 131 mm/s, 129 mm/s, and 136 mm/s, respectively. Example 3-4 to Example 3-7 were also different from Example 3-3 in that the temperature of the support member 30 on which the metal foil 10 was disposed was set to 100° C., 200° C., 300° C., 400° C., respectively. The appearances of the metal foils 10 obtained by heating were confirmed. The results are shown in Table 2. Space factors of the obtained laminates in Example 3-5 and Example 3-6 were calculated as in Example 2-1. The results are shown in Table 2.

TABLE 2

| | Material of support member | Thermal conductivity of support member (W/mK) | Temperature of support member (° C.) | Appearance of metal foil | Space factor (%) |
|---|---|---|---|---|---|
| Example 3-1 | Calcium silicate | 0.2 | Ambient temperature | No crease | 95.3 |
| Example 3-2 | Glass fiber and cement | 0.4 | Ambient temperature | With crease | 81.2 |
| Example 3-3 | Steel | 51.6 | Ambient temperature | With crease | — |
| Example 3-4 | Steel | 51.6 | 100° C. | With crease | — |
| Example 3-5 | Steel | 51.6 | 200° C. | With crease | 76.2 |
| Example 3-6 | Steel | 51.6 | 300° C. | No crease | 95.5 |
| Example 3-7 | Steel | 51.6 | 400° C. | No crease | — |

As can be clearly seen from Table 2, when Example 3-1 to Example 3-3 were compared to each other, the metal foil 10 in Example 3-1 did not have a crease and the space factor of the laminate in Example 3-1 was higher than that in Example 3-2. In Example 3-1 to Example 3-3, the thermal conductivities of the support member 30 greatly vary. It is assumed that use of the support member 30 made of material having a low thermal conductivity (0.2 W/mK or lower) as in Example 3-1 can prevent the heat of the metal foil 10 from locally escaping to the support member 30 and uniformly heat the metal foil 10, and thus plastic deformation of the metal foil 10 during crystallization is less likely to occur.

As can be clearly seen from Table 2, when Example 3-3 to Example 3-7 were compared to each other, the metal foils 10 in Example 3-6 and Example 3-7 did not have a crease and the space factor of the laminate in Example 3-6 was higher than that in Example 3-5. In Example 3-3 to Example 3-7, the temperatures of the support member 30 greatly vary. It is assumed that setting the temperature of the support member 30 to 300° C. or higher as in Example 3-6 and Example 3-7 can make the temperature of the support member 30 close to the temperature of the base 2, prevent the heat of the metal foil 10 from locally escaping to the support member 30, and uniformly heat the metal foil 10, and thus plastic deformation of the metal foil 10 during crystallization is less likely to occur.

Example 4-1 to Example 4-4

A laminate was produced by the same process as in Example 3-1. Example 4-1 to Example 4-4 were different from Example 3-1 in that the metal foil 10 was sandwiched between the base 2 and the support member 30 by bringing the base 2 close to the support member 30 such that a relative moving speed between the base 2 and the support member 30 of the heating device 1B shown in FIG. 6C was 21 mm/s, 86 mm/s, 125 mm/s, 531 mm/s, respectively. It should be noted that Example 4-3 was the same as Example 3-1. The appearances of the metal foils 10 obtained by heating were confirmed. The results are shown in Table 3. Space factors of the obtained laminates in Example 4-2 and Example 4-3 are also shown in Table 3.

TABLE 3

| | Moving speed (mm/s) | Thermal conductivity of support member (W/mK) | Temperature of support member (° C.) | Appearance of metal foil | Space factor (%) |
|---|---|---|---|---|---|
| Example 4-1 | 21 | 0.2 | Ambient temperature | With crease | — |
| Example 4-2 | 86 | 0.2 | Ambient temperature | With crease | 82.1 |
| Example 4-3 | 125 | 0.2 | Ambient temperature | No crease | 95.3 |
| Example 4-4 | 531 | 0.2 | Ambient temperature | No crease | — |

As can be clearly seen from Table 3, when Example 4-1 to Example 4-4 were compared to each other, the metal foils 10 in Example 4-3 and Example 4-4 did not have a crease and the space factor of the laminate in Example 4-3 was higher than that in Example 4-2. In Example 4-1 to Example 4-4, the moving speeds of the support member 30 greatly vary. It is assumed that setting the moving speed of the support member 30 to 125 mm/s or higher as in Example 4-3 and Example 4-4 can instantly insert the metal foil 10 into the base 2 and the support member 30 and uniformly heat the metal foil 10, and thus plastic deformation of the metal foil 10 during crystallization is less likely to occur.

While the embodiments of the present disclosure have been described in detail above, the present disclosure is not limited thereto, and can be subjected to various kinds of changes of design without departing from the spirit and scope of the present disclosure described in the claims.

In the present embodiment, a stator core of a motor is produced by laminating metal foils made of nano-crystal soft magnetic material, but a rotor core of a motor may be produced by laminating metal foils.

Although the placement surface of the base faces up in the present embodiment, for example, the placement surface of the base may face down to bring it closer to the metal foil downwardly from the above to adsorb the metal foil. The metal foil may be heated while being delivered together with the base.

Although the temperature (heating temperature) of the placement surface of the base is constant in the present embodiment, for example, the temperature of the placement surface may be lowered by stopping the heating by the heater at a time when the metal foil generates heat by itself.

What is claimed is:

1. A method for producing metal foils made of nano-crystal soft magnetic material, the method comprising:

preparing a metal foil made of amorphous soft magnetic material, wherein in the preparing the metal foil, a molten metal obtained by melting material of the metal foil is blown onto a rotating roll, and the molten metal is cooled and solidified on the roll to produce the metal foil made of the amorphous soft magnetic material, and wherein in the preparing the metal foil, the metal foil has an even surface and an uneven surface; and heating the metal foil while bringing the even surface of the metal foil into close contact with a base made of metal such that the metal foil conforms to a placement surface of the base and bringing the uneven surface of the metal foil into close contact with a support member with low thermal conductivity, to crystallize the amorphous soft magnetic material of the metal foil into the nano-crystal soft magnetic material, wherein in a crystallization, the metal foil is heated at a heating temperature to crystallize the amorphous soft magnetic material, the heating temperature being higher than or equal to a crystallization starting temperature at which the amorphous soft magnetic material crystallizes into the nano-crystal soft magnetic material and allowing a temperature of the placement surface to be lower than a temperature of the metal foil having temperature rise due to heat generated by self-heating during crystallization, and the base absorbs more heat generated by self-heating during crystallization than the support member, and wherein in the crystallization, bringing the even surface of the metal foil into close contact with the base includes sucking the even surface of the metal foil from a plurality of suction ports formed on the placement surface of the base such that the plurality of suction ports prevent local decrease of the temperature of the placement surface when the metal foil is in close contact with the base.

2. The method for producing metal foils according to claim 1, wherein in the crystallization, the metal foil is heated by a heater embedded in the base.

3. A method for producing metal foils made of nano-crystal soft magnetic material, the method comprising:

preparing a metal foil made of amorphous soft magnetic material, wherein in the preparing the metal foil, a molten metal obtained by melting material of the metal foil is blown onto a rotating roll, and the molten metal is cooled and solidified on the roll to produce the metal foil made of the amorphous soft magnetic material, and wherein in the preparing the metal foil, the metal foil has an even surface and an uneven surface; and heating the metal foil while bringing the even surface of the metal foil into close contact with a base made of metal such that the metal foil conforms to a placement surface of the base and bringing the uneven surface of the metal foil into close contact with a support member with low thermal conductivity, to crystallize the amorphous soft magnetic material of the metal foil into the nano-crystal soft magnetic material, wherein in the crystallization, the base absorbs more heat generated by self-heating during crystallization than the support member, and wherein the bringing the even surface of the metal foil into close contact with the base includes sucking the even surface of the metal foil that was in contact with the roll from a plurality of suction ports formed on the placement surface of the base such that the plurality of suction ports prevent local decrease of the temperature of the placement surface.

4. The method for producing metal foils according to claim 1, wherein:

in the preparing the metal foil, a metal foil made of iron-based amorphous soft magnetic material is prepared as the metal foil;

in the crystallization, the metal foil is sandwiched between the base and the support member by moving at least one of the base or the support member in a direction to bring the base and the support member close to each other to bring the metal foil into close contact with the base, and the metal foil is heated by a heater embedded in the base; and in the crystallization, at least two the following conditions are satisfied:

(i) material of the support member has a thermal conductivity of 0.2 W/mK or lower;

(ii) the support member has a temperature of 300° C. or higher and lower than the crystallization starting temperature; and (iii) bringing the base and the support member close to each other at a moving speed greater than or equal to 125 mm/s.

* * * * *